US012209478B2

(12) United States Patent
Fripp et al.

(10) Patent No.: US 12,209,478 B2
(45) Date of Patent: Jan. 28, 2025

(54) PLUG AND ABANDON WITH FUSIBLE ALLOY SEAL

(71) Applicant: Halliburton Energy Services, Inc., Houston, TX (US)

(72) Inventors: Michael Linley Fripp, Singapore (SG); Wei Zhang, Houston, TX (US); Brandon T Least, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 183 days.

(21) Appl. No.: 17/835,118

(22) Filed: Jun. 8, 2022

(65) Prior Publication Data

US 2023/0399917 A1 Dec. 14, 2023

(51) Int. Cl.

| | |
|---|---|
| ***E21B 33/12*** | (2006.01) |
| ***C22C 12/00*** | (2006.01) |
| ***E21B 36/00*** | (2006.01) |

(52) U.S. Cl.

CPC ..... *E21B 33/1204* (2013.01); *C22C 12/00* (2013.01); *E21B 36/008* (2013.01)

(58) Field of Classification Search

CPC ..... E21B 33/1204; E21B 36/008

See application file for complete search history.

(56) References Cited

U.S. PATENT DOCUMENTS

| | | | | |
|---|---|---|---|---|
| 7,640,965 | B2 | 1/2010 | Bosma et al. | |
| 9,932,791 | B2 | 4/2018 | Walton et al. | |
| 10,053,950 | B2 | 8/2018 | Carragher | |
| 10,145,194 | B2 | 12/2018 | Dagenais et al. | |
| 2013/0333890 | A1* | 12/2013 | Dagenais | E21B 29/02 166/302 |
| 2015/0345250 | A1* | 12/2015 | Murphree | E21B 43/08 166/292 |
| 2016/0047199 | A1* | 2/2016 | Hardesty | E21B 43/116 166/57 |
| 2016/0319633 | A1 | 11/2016 | Cooper et al. | |
| 2019/0085659 | A1 | 3/2019 | Carragher et al. | |
| 2019/0128092 | A1 | 5/2019 | Mueller et al. | |
| 2019/0144355 | A1 | 5/2019 | Carragher | |
| 2021/0032980 | A1* | 2/2021 | Fripp | E21B 33/1212 |

FOREIGN PATENT DOCUMENTS

| | | | |
|---|---|---|---|
| EP | 3196402 | A1 | 1/2016 |
| WO | 2014096857 | A2 | 6/2014 |
| WO | 2019151870 | A1 | 8/2019 |

OTHER PUBLICATIONS

Foreign Communication from Related Application—International Search Report and Written Opinion of the International Searching Authority, International Application No. PCT/US2022/035077, dated Mar. 7, 2023, 11 pages.

* cited by examiner

*Primary Examiner* — Silvana C Runyan

(74) *Attorney, Agent, or Firm* — Conley Rose, P.C.; Rodney B. Carroll

(57) ABSTRACT

A method of creating a seal in a tubular by melting a first component comprising a fusible alloy, using heat produced by an exothermic, hydrolysis reaction of a second component comprising a metal, to provide a melted fusible alloy, and allowing the melted fusible alloy to solidify in the tubular, wherein the fusible alloy expands upon solidifying and forms the seal. A system for carrying out the method is also provided.

20 Claims, 6 Drawing Sheets

PLUG AND ABANDON WITH FUSIBLE ALLOY SEAL

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present disclosure relates generally to creating a seal, such as for plug and abandon. More specifically, the present disclosure relates to creating a seal with a fusible alloy. Still more specifically, the present disclosure relates to creating a fusible alloy seal with heating provided by a metal hydrolysis reaction, such as a magnesium hydrolysis reaction.

BACKGROUND

Seals are utilized in a variety of oil and gas and non-oil and gas applications, for example to restrict or prevent fluid flow during downhole operations such as, without limitation, for plug and abandon of wells, for casing packers (e.g., for open hole isolation), bridge plugs, frac plugs, or temporary barriers that can later be removed, for example, by drilling or re-heating.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
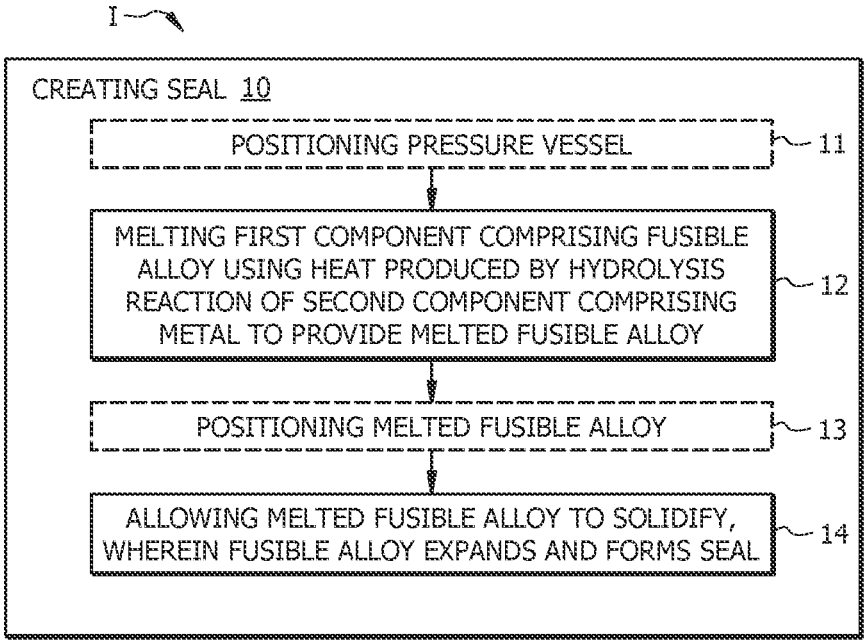
FIG. 1 is a schematic flow diagram of a method, according to embodiments of this disclosure.

It should be understood at the outset that although an illustrative implementation of one or more embodiments are provided below, the disclosed systems and/or methods can be implemented using any number of techniques, whether currently known or in existence. The disclosure should in no way be limited to the illustrative implementations, drawings, and techniques below, including the exemplary designs and implementations illustrated and described herein, but can be modified within the scope of the appended claims along with their full scope of equivalents.

Disclosed herein are systems and methods for forming fusible alloy seals, such as can be utilized, for example, for plug and abandon of wells. The seals are created via the use of a fusible alloy. The seal can be utilized, for example, for plug and abandon of a well, a casing packer (e.g., for open hole isolation), a bridge plug, a frac plug, or a temporary barrier that could later be removed, for example, by drilling or re-heating. Although described in relation to downhole seal, the system and method of this disclosure can be utilized in other applications, including non-wellbore applications.

As noted above, via this disclosure, a seal can be created, for example in a wellbore, with a fusible alloy. A fusible alloy of this disclosure can be a metal alloy with a low melting temperature or temperature range, such as a melting temperature of less than or equal to about 550, 525, 500 or 450° F. In embodiments, the fusible alloy is or comprises a phase-expanding fusible alloy. A phase-expanding fusible alloy expands upon phase change from liquid to solid. The phase-expanding alloy can contain bismuth, lead, tin, cadmium, antimony, copper, indium, or a combination thereof. Fusible alloys can be a eutectic, hypo-eutectic, or hyper-eutectic. Although referred to as a fusible alloy, as utilized herein, a fusible alloy can, in embodiments, comprise a single metal, such as pure bismuth, while, in other embodiments, the fusible alloy can include at least two metals. In embodiments, the fusible alloy comprises a single component metal. In embodiments, the fusible alloy comprises a multi-component metal, having, for example, 2, 3, 4, 5, 6, or more metals in combination. Hypo-eutectic and hyper-eutectic fusible alloys comprise at least two metals. The temperature at which the fusible alloy undergoes a phase transformation from a solid to a liquid can be predetermined. The ratio of the metals in the fusible alloy can be adjusted to yield a predetermined/desired phase transformation temperature or temperature range for formation of the seal.

A eutectic composition is a mixture of two or more metals that undergoes a solid-liquid phase transformation at a lower temperature than any other composition made up of the same metals. A eutectic composition, by definition, cannot contain only a single metal. That is, the temperature at which a eutectic composition undergoes the solid-liquid phase transformation (known as the "eutectic temperature") is lower than a temperature at which any other composition made up of the same substances can freeze or melt. A solid-liquid phase transformation temperature can also be referred to herein as the freezing point or melting point of the substance or composition. The eutectic composition undergoes the solid-liquid phase transformation at a temperature that is lower than the solid-liquid phase transformation temperature of at least one of the individual substances making up the eutectic composition. The solid-liquid phase transformation temperature can be greater than one or more of the individual substances making up the composition, but is less than at least one of the substances. By way of example, the melting point of bismuth at atmospheric pressure is 520° F. (271° C.) and the melting point of lead is 621° F. (327° C.); however, the melting point of a composition containing 55.5% bismuth and 44.5% lead has a melting point of 244° F. (118° C.). The bismuth-lead composition has a much lower melting point than either elemental bismuth or elemental lead. Not all compositions have a melting point that is lower than all of the individual substances making up the composition. By way of example, a composition of silver and gold has a higher melting point compared to pure silver and pure gold. Therefore, a silver-gold composition cannot be classified as a eutectic composition.

A eutectic composition can also be differentiated from other compositions because it solidifies (or melts) at a single, precise temperature. Non-eutectic compositions generally have a range of temperatures at which the non-eutectic composition melts. Non-eutectic alloys tend to transition through a semi-liquid state between being liquid and being solid. There are other compositions that can have both a range of temperatures at which the composition melts and a melting point less than at least one of the individual substances making up the composition. These other compositions can be referred to herein as hypo- and hyper-eutectic compositions. A hypo-eutectic composition contains the minor substance (i.e., the substance that is in the lesser concentration) in a smaller amount than in a eutectic composition of the same substances. A hyper-eutectic composition contains the minor substance in a larger amount than in the eutectic composition of the same substances. Generally, with few exceptions, a hypo- or hyper-eutectic composition will have a solid-liquid phase transition temperature that is higher than the eutectic temperature but less than the melting point of at least one of the individual substances making up the hypo- or hyper-eutectic composition. An potential advantage of using a hypo- or hyper-eutectic composition, according to embodiments of this disclosure, can be that hypo- or hyper-eutectic compositions can provide a wider array of possible melting temperatures via alloying, whereas eutectic compositions are only available at specific melting temperatures. Another advantage of using a hypo- or hyper-eutectic composition as per embodiments of this disclosure can be that in the semi-liquid temperature range, the material can be characterized as a slurry or having slushy characteristics, facilitating the holding thereof at a desired location for placing the seal via (e.g., mechanical) flow barriers, as described hereinbelow. A fusible material can be considered to be a slurry if it has a combination of solid and liquid components over a range of temperatures.

At low temperature, the fusible alloy is a solid, while at high temperature, the metal is a liquid. In a metal alloy that has a eutectic alloying percentage or a fusible metal with a single component, the metal transforms directly from a solid to a liquid and from a liquid back to a solid. In a hypo-eutectic alloy or a hyper-eutectic alloy, the fusible alloy has a region where it is partially liquid and partially solid. In this multi-melt region, solid metal can be found in an amount of liquid metal. Accordingly, hypo-eutectic and hyper-eutectic fusible alloys can be referred to herein as "multi-melt" (e.g., multi-melt compositions, multi-melt fusible alloys, multi-melt materials). The term "multi-melt" is utilized to indicate that there is not a single temperature at which the hypo-eutectic or hyper-eutectic alloy will melt. Rather, the hypo-eutectic alloy or the hyper-eutectic alloy will melt over a temperature range. Without being limited by theory, a hypo-eutectic fusible alloy or a hyper-eutectic fusible alloy or can be particularly useful when utilized in embodiments of this disclosure to form seal in the temperature region where the fusible alloy is partially solid and partially liquid because the solid components can help to bridge any gaps or cracks in the support that is holding the molten (or partially molten) metal in place while it fully solidifies, thus providing a more complete or reliable seal. A hypo-eutectic fusible alloy or a hyper-eutectic fusible alloy can also be referred to herein as a "hypo-eutectic composition" or a "hyper-eutectic composition", or simply a "hypo-eutectic" or a "hyper-eutectic", respectively.)

A fusible alloy that is non-expanding as it changes phase (also referred to herein as a "non-phase-expanding fusible alloy") is a "normal" alloy. A non-phase-expanding fusible alloy can contract or maintain volume as it solidifies and expand or remain the same volume as it melts. As a result, a non-expanding fusible alloy can be less desirable than a phase-expanding fusible alloy for use as an anchor for a seal as described herein; that is, less desirable for use (in the absence of a phase-expanding fusible alloy) as first component 51 described hereinbelow. However, a non-phase-expending fusible alloy can hold a lot of heat capacity via latent heat of fusion, and thus can be utilized as a component of the first component, as described hereinbelow, in conjunction with a phase-expanding fusible alloy, in embodiments.

By way of example, Table 1 illustrates eutectic, hypo-eutectic and hyper-eutectic compositions, the concentration of each substance included in the composition (expressed as a percent by weight of the composition), and the corresponding eutectic temperature and melting temperature ranges. As can be seen from Table 1, the hyper-eutectic composition contains cadmium (the minor substance) in a larger amount than the eutectic composition, and the hypo-eutectic composition contains cadmium in a smaller amount than in the eutectic composition. As can also be seen in Table 1, both the hyper- and hypo-eutectic compositions melt over a range of temperatures; whereas, the eutectic composition has a single melting (e.g., "eutectic") temperature. Moreover, all three compositions have a eutectic temperature or melting point range that is lower than each of the four individual elements—bismuth (Bi) melts at 520° F. (271.1° C.), lead (Pb) melts at 621° F. (327.2° C.), tin (Sn) melts at 450° F. (232.2° C.), and cadmium (Cd) melts at 610° F. (321.1° C.).

TABLE 1

| Type of Composition | Concentration of Bismuth | Concentration of Lead | Concentration of Tin | Concentration of Cadmium | Melting Temperature (F.) |
|---|---|---|---|---|---|
| Eutectic | 50 | 26.7 | 13.3 | 10 | 158 |
| Hyper-Eutectic | 50 | 25 | 12.5 | 12.5 | 158-165 |
| Hypo-Eutectic | 50.5 | 27.8 | 12.4 | 9.3 | 158-163 |

A method of this disclosure will now be described with reference to FIGS. 1-4, which are schematic flow diagrams of methods according to this disclosure, FIG. 5A, which is a schematic of a downhole tool 50, according to embodiments of this disclosure, and FIG. 5B, which is a schematic of a seal 59, according to embodiments of this disclosure.

As depicted in FIG. 1, a Method I of this disclosure can comprise: creating a seal 59 (FIG. 5B) (e.g., in a tubular 54) at 10 by melting a first component 51 comprising a fusible alloy (also referred to herein as a fusible alloy 51), using heat produced by an exothermic, hydrolysis reaction of a second component 52 comprising a metal (also referred to herein as metal 52), to provide a melted fusible alloy 53 (also referred to herein as a melted material 53 or melted first component 53); and, as depicted at 14, allowing the melted fusible alloy 53 to solidify (e.g., in the tubular 54), wherein the fusible alloy expands upon solidifying and forms the seal 59.

In embodiments, the fusible alloy expands at least 0.005%, 0.05, 0.1, 0.2, 0.3, 0.4, 0.5, 0.6, 0.7, 0.8, 0.9, 1, 2, 3, 4, or 5 volume percent (vol %), or in a range of from about 0.05 to 5, 0.1 to 5, or 0.1 to 1 vol % upon solidifying. For example, a fusible alloy comprising 52.5% bismuth (Bi)+32% lead (Pb)+15.5% tin (Sn) can have an expansion of 0.0055%, while a fusible alloy comprising 100% gallium (Ga) can expand by about 3.1 vol % upon solidifying. In embodiments, the fusible alloy has a solidus temperature (i.e., a lowest temperature at which the fusible alloy is completely liquid) of less than or equal to 550, 540, 530, 520, 510, 500, 475, 450, 425, 400, 375, or 360° F. (288, 282, 277, 271, 266, 260, 246, 232, 218, 204, 191, or 183° C.). For example, in embodiments, the fusible alloy has a solidus temperature that is less than the solidus temperature of bismuth (e.g., 520° F. (271° C.)).

The volume expansion of the phase-expanding fusible alloy from solidification can be small (e.g., less than about 5 vol %), but the melted fusible alloy is quiescent (e.g., is held still by flow barrier 58 or magnet(s) 70, as described further hereinbelow) which can result in a high sealing force. For example, bismuth alloys can have 1% to 2% expansion by volume upon solidification. Gallium alloys can expand up to 3 vol % on solidification. The expansion can compress the alloy and enhance the seal 59. As noted hereinabove, other metal and metalloid alloys that can expand upon freezing include, among others, antimony, gallium, germanium, plutonium. Examples of phase change metallic fusible alloys that expand upon freezing are shown in the Table 2 below.

TABLE 2

Exemplary Phase-Expanding Fusible Alloys

| Composition | Freezing Point (° F. (° C.)) | Volume Expansion Upon Freezing (vol %) | Tensile Strength (psi) |
|---|---|---|---|
| 100% Ga | 85 (29) | 3.1% | 2100 |
| 45% Bi 23% Pb 8% Sn 5% Cd 19% In | 117 (47) | 1.4% | 5400 |
| 43% Bi 38% Pb 11% Sn 9% Cd | 160 (71)-190 (88) | 2.0% | 5400 |
| 48% Bi 28% Pb 15% Sn 9% Sb | 218 (103)-440 (227) | 1.5% | 13,000 |
| 55% Bi 45% Pb | 255 (124) | 1.5% | 6400 |
| 100% Bi | 520 (271) | 3.3% | 2900 |

The fusible alloy of first component 51 can comprise a metal, a metalloid, an alloy thereof, or a combination thereof. By way of non-limiting examples, the fusible alloy can comprise bismuth (Bi), gallium (Ga), antimony (Sb), germanium (Ge), an alloy thereof, or a combination thereof, in embodiments. In embodiments, the fusible alloy comprises greater than 40 weight percent (wt %) Bi (e.g., greater than or equal to about 40, 50, 60, 70, 80, 90, or 100 wt % Bi). In embodiments, the first component comprises greater than about 40 weight percent (wt %) gallium (Ga) (e.g., greater than or equal to about 40, 50, 60, 70, 80, 90, or 100 wt % Ga). First component 51 can comprise at least two fusible alloys, having different melting temperatures, as described further hereinbelow with reference to FIG. 6A and FIG. 6B.

In embodiments, the fusible alloy comprises a bismuth (Bi) alloy, further comprising lead (Pb), tin (Sn), cadmium (Cd), indium (In), antimony (Sb), or a combination thereof. In embodiments, the fusible alloy is a hypo-eutectic alloy or a hyper-eutectic alloy.

Inert materials having a high heat capacity can be utilized to help transfer heat into the forming seal 59. For example, in embodiments, iron granules can be incorporated into first component 51 (e.g., can be combined with the (e.g., phase-expanding) fusible alloy in order to help retain heat in the location of the fusible alloy during the time between when the tool 50 is activated (e.g., when the hydrolysis reaction between water of a water-based liquid 57 comprising water and optionally acid or base 56) contacts the metal of second component 52) and when the seal 59 is formed. In embodiments, a non-phase-expanding fusible alloy can be utilized in combination with a phase-expanding fusible alloy to help transfer heat from the heat generator (i.e., the hydrolysis reaction) to the seal 59. The iron granules can be designed (e.g., acicular shaped) to act as a reinforcement to the new seal 59. In embodiments, the inert material can be a ceramic, such as alumina, magnesia, zirconia, or silica. Accordingly, in embodiments, first component 51 can further comprise an inert material with a heat capacity of greater than about 2, 2.5, 3, or 3.5 MJ/($Km^3$), and/or heat transfer fins (e.g., of a flow barrier 58) distributed throughout to transfer heat from the hydrolysis reaction to the first component 51. For example, iron has a volumetric heat capacity of 3.4 MJ/($Km^3$), while bronze has a volumetric heat capacity of 3.7 MJ/($Km^3$). The inert material can comprise particles (e.g., iron, bronze, nickel granules or powder, or a combination thereof). The inert material can comprise (e.g., iron) particles that are acicular (i.e., needle shaped), cylindrical, elliptical, granular, planar, or a combination thereof. In embodiments, first component 51 can comprise a phase-expanding fusible alloy and a non-phase-expanding fusible alloy, in embodiments.

In embodiments, the first component 51 (e.g., comprising the fusible alloy) is constructed like a plug. Thus, first component 51 can comprise a wiper plug or bridge plug comprising a phase-expanding fusible alloy. The plug can be machined from the fusible alloy or cast into shape. The plug can be set, lowered, or pumped to a desired location, at which point the heat source can be activated to initiate the hydrolysis reaction and soften the plug. Upon passing through the solidus temperature, the phase-expanding material expands and forms the seal 59.

In embodiments, the second component 52 does not comprise a metal oxide, such as iron oxide or a ceramic. In embodiments, thermite is not utilized to make the seal 59. In embodiments, the second component 52 comprises a metal that is shiny, ductile, malleable, electrically conductive, and thermally conductive. The metal can comprise barium (Ba), calcium (Ca), lithium (Li), aluminum (Al), magnesium (Mg), or a combination thereof. In embodiments, the second component 52 comprises, consists essentially of, or consists of magnesium (Mg). The second component 52 can comprise an alkaline earth metal, a transition metal, a post-transition metal, or a combination thereof. The second component 52 can comprise magnesium (Mg), calcium (Ca), aluminum (Al), zinc (Zn), or a combination thereof. The second component 52 can comprise magnesium (Mg) or a Mg alloy comprising Mg and one or more additional metals. The one or more additional metals can comprise aluminum (Al), zinc (Zn), manganese (Mn), zirconium (Zr), yttrium (Y), neodymium (Nd), gadolinium (Gd), silver (Ag), calcium (Ca), tin (Sn), rhenium (Re), or a combination thereof.

The second component 52 (e.g., a Mg alloy) can further comprise a dopant, such as, without limitation, nickel (Ni), iron (Fe), copper (Cu), cobalt (Co), iridium (Ir), gold (Au), palladium (Pd), gallium (Ga), magnesium (Mg), or a combination thereof.

The hydrolysis reaction can be between the metal of the second component 52 and water of a water-based liquid 57. The water-based liquid 57 can comprise water and an acid or a base 56. Accordingly, in embodiments, the hydrolysis reaction can occur in the presence of an organic acid or an inorganic acid. The acid can comprise hydrochloric acid, citric acid, acetic acid, formic acid, hydrofluoric acid, carbonic acid, or a combination thereof. By way of example, the hydrolysis reaction can comprise a reaction of magnesium (Mg) of the second component 52 with water of the water-based liquid 57. The water-based liquid can be acidic, for example, having a pH of less than or equal to about 4, 3, or 2, in embodiments.

The generalized metal dissolution reaction (the hydrolysis reaction) is depicted in Equation (1):

$$X_{(s)}+2H_2O_{(l)}\rightarrow X(OH)_{2\ (g\ or\ s)}H_{2\ (g)}+\text{heat}, \quad (1)$$

wherein X comprises the metal.

The metal X of the second component 52 can comprise calcium, barium, strontium, lithium, aluminum, magnesium, or another metal, or combination thereof, as noted herein. For example, when the second component 52 comprises the metal magnesium, the hydrolysis can be depicted as in Equation (2):

$$Mg+2H_2O\rightarrow Mg(OH)_2+H_2+\text{heat} \quad (2)$$

The metal hydroxide can precipitate from the water-based fluid 57 (e.g., water) to form a solid metal hydroxide. The hydrolysis reaction is exothermic, thus providing heat to melt the fusible alloy. For reaction with liquid water, the heat released, for example via the magnesium hydrolysis reaction of Equation (2), is the standard enthalpy of formation for the magnesium hydroxide (924 KJ/mol) minus twice the standard enthalpy of formation for liquid water (−2×285 KJ/mol)=354 KJ/mol released. Thus, by way of example, an 8 pound section of magnesium represents 149 mol of magnesium. This can release roughly 53 MJ of energy in the form of heat. The hydrolysis reaction (e.g., magnesium-water hydrolysis reaction) can be utilized to heat the (e.g., phase-expanding) fusible alloy of first component 51 to provide a melted fusible alloy or melted material 53. The hydrolysis reaction is designed to generate sufficient heat to melt the first component 51 (e.g., the fusible alloy), such that the melted first component can flow to a blockage or flow barrier 58, and then to expand as it phase changes back to a solid (e.g., to expand upon cooling).

The speed at which the heat of Equation (1) is produced can be varied by the addition of dopants into the second component 52 with the metal, and/or via alteration of the pH or the addition of other additives in the fluid. For example, adding an anhydrous acid powder to the dropped metal can make the (e.g., wellbore) fluid more acidic. This can accelerate the hydrolysis reaction and help ensure that all of the particulates stay in solution rather than precipitating (e.g., into the wellbore). As mentioned hereinabove, the acid 56 can be an inorganic acid, like HCl, or it can be an organic acid, such as, citric, acetic, or formic acid. Via the use of acid 56, the heat of the hydrolysis reaction can be generated over a short period of time, such as, for example, 15 minutes, or over an extended period of time, such as, for example, 14 days. As discussed hereinbelow with reference to FIG. 5A, acid or base (e.g., concentrated acid or base) 56 can be contained in a separate vessel that can be flushed around the metal of second component 52 to accelerate the hydrolysis reaction.

The metal dissolution reaction with an acid is depicted in Equation (3):

$$Mg_{(s)}+2HCl_{(aq)}\rightarrow Mg^{2+}{}_{(aq)}+2Cl^{-}{}_{(aq)}+H_{2(g)}+\text{heat} \quad (3).$$

The energy released from the acid-driven reaction of Equation (3) is 462 kJ per mol of magnesium. Thus, by way of example, an 8-pound section of magnesium represents 69 MJ of energy in the form of heat.

By way of further example, in embodiments, the metal of the second component 52 can comprise aluminum, and the aluminum hydrolysis reaction can be as depicted in Equation (4):

$$Al+3H_2O\rightarrow Al(OH)_3+3/2H_2 \quad (4).$$

The aluminum hydroxide can become insoluble in the water (e.g., water-based fluid 57) and precipitate as a solid.

The heat generated from the aluminum reaction of Equation (4) is approximately 1277-(3×285)=422 KJ/mol. Accordingly, by way of example, an 8 pound section of aluminum represents 134 mol of aluminum, and can release roughly 56 MJ of energy in the form of heat.

Aluminum and zinc are amphoteric which means that their dissolution can be accelerated with either an acid or a base 56.

The hydrolysis of any metal can be effected to create heat for the melting. Accordingly, the metal of second component 52 is not particularly limited. However, as noted hereinabove, in embodiments, the metal of the second component 52 comprises an alkaline earth metal (Mg, Ca, etc.) or a transition metal (Al, Zn etc.) to participate in the hydrolysis reaction and provide the heat for melting of the fusible alloy of the first component 51.

In embodiments, the second component 52 comprises a magnesium alloy, such as, without limitation, magnesium alloys that comprise magnesium (Mg) alloyed with aluminum (Al), zinc (Zn), manganese (Mn), zirconium (Zr), yttrium (Y), neodymium (Nd), gadolinium (Gd), silver (Ag), calcium (Ca), tin (Sn), and/or rhenium (Re). In some applications, the alloy of the second component 52 is further alloyed with a dopant that promotes corrosion, such as, without limitation, Ni, Fe, Cu, Co, Ir, Au, and Pd. In some applications, the alloy is alloyed with a dopant that reduces passivation, such as, without limitation, Ga, Mg. The second component 52 can be constructed in a solid solution process where the elements thereof are combined with molten base metal or base metal alloy. Alternatively, the metal alloy of the second component 52 can be constructed via a powder metallurgy process.

The latent heat of fusion for a fusible alloy will depend on the constituents of the alloy. By way of example, for a phase-expanding fusible alloy consistent of 100% bismuth, the latent heat of fusion is 54 kJ/kg. Assuming that 10% of the heat from the metal hydrolysis reaction is used to heat such a fusible alloy and 90% is lost to the environment, then the 8-pound section of aluminum can be utilized to melt 100 kg of the aluminum fusible alloy to produce a melted aluminum fusible alloy 53. Accordingly, for a given fusible alloy of first component 51, a suitable selection of the metal(s) of second component and amount(s) thereof can be selected to ensure melting of the fusible alloy of the first component by the heat provided via the exothermic hydrolysis reaction of the metal(s).

As depicted at 13 in FIG. 1, Method I can further comprise positioning the seal at a desired location (e.g., within a tubular 54). Positioning 13 can comprise restricting or preventing axial fluid flow (e.g., within the tubular 54) at the desired location. Positioning 13 can comprise restricting axial fluid flow via placement of a flow barrier 58 (e.g., within the tubular 54; FIG. 5A). The flow barrier 58 can comprise one or a plurality of fins, wipers, whiskers, cups, or another flow barrier 58 that restricts axial flow of fluid (e.g., within the tubular 54).

Figure 7:
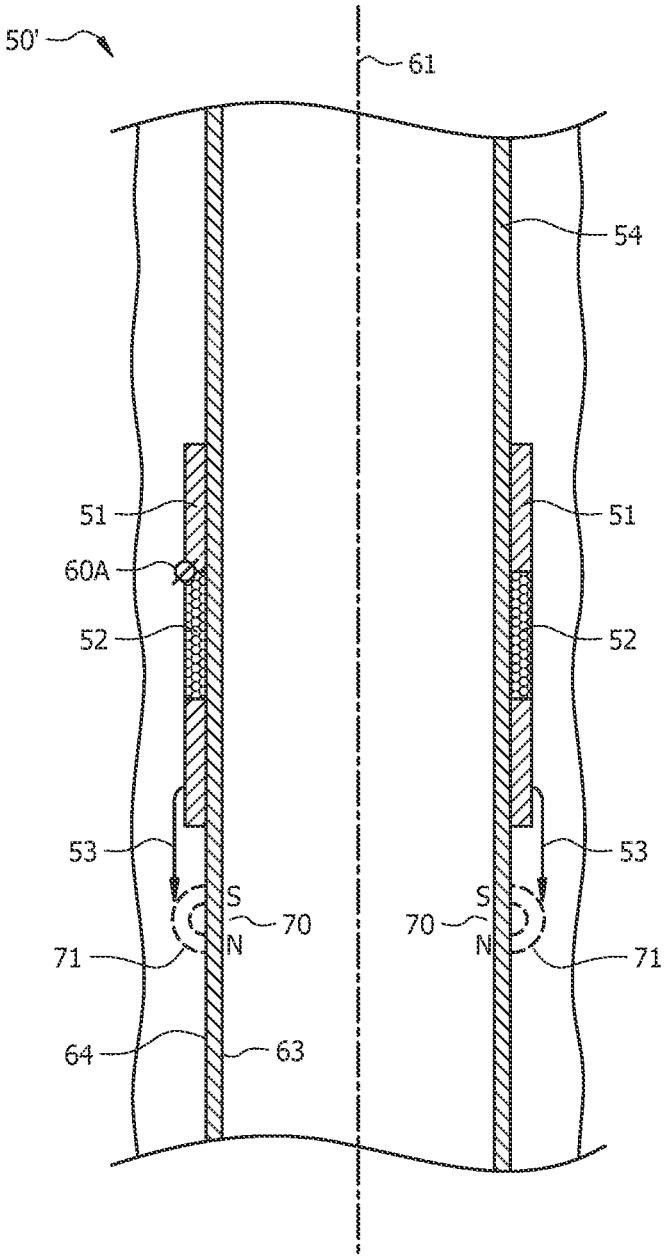
FIG. 7 is a schematic of a downhole tool, according to embodiments of this disclosure.

In embodiments, as described further hereinbelow with reference to FIG. 7, the melted fusible alloy 53 is a magnetorheological fusible alloy (also referred to herein as a "magnetorheological material), and positioning 13 can comprise utilizing one or more magnets 70 to guide placement of the melted fusible alloy 53. A magnetorheological fusible alloy can be a fusible alloy combined (e.g., mixed) with a ferrous material, such that the resulting combined material responds to a magnetic field. In embodiments, a ferrous material (such as iron or nickel powder) with an average diameter between 1 micron and 1 mm is mixed with a phase-expanding fusible alloy, where the ferrous material constitutes between 2% and 50% of the volume of the resulting magnetorheological fusible alloy.

As depicted in FIG. 1, creating the seal 10 can further comprise positioning a pressure vessel 55 and (e.g., pellets of) the first component 51 (e.g., within the tubular 54). The pressure vessel 55 can contain the first component 51 and the second component 52. The pressure vessel 55 can be or can be contained within a downhole tool 50. Downhole tool 50 can comprise any downhole tool, such as, without limitation, a wireline or slickline tool, as depicted in FIG. 5A. The downhole tool 50 comprises the second component 52 comprising the metal (e.g., pellets of magnesium) in pressure vessel 55. When an activation component 60 (e.g., a rupture disc), as described further hereinbelow, at the top, in the embodiment of FIG. 5A, but elsewhere in other embodiments, is activated (e.g., opened), water from outside pressure vessel 50 can flood into the downhole tool 50. The water chemically reacts with the metal (e.g., magnesium) of the second component 52 within pressure vessel 55 per the hydrolysis reaction of Equation (1) to generate heat. The heating reaction can, in embodiments, be accelerated by having the top section of the tool 50 filled with concentrated acid (or base, depending on the reaction) 56, as depicted in the embodiment of FIG. 5A. The acid 56 can be separated from the metal (e.g., magnesium) of the second component 52 with a second activation component 60' (e.g., a second rupture disc) that is designed/configured to break when the hydrostatic pressure acts upon the acid 56 or otherwise allow the water-based liquid 57 to contact the second component 52.

The first component 51 can be adjacent the metal of the second component 52. The pressure vessel 55 can comprise activation component 60 configured to, when activated, cause failure of a barrier 62 (e.g., a wall of/within pressure vessel 55) such that water of water-based fluid 57 contacts the metal of second component 52 to initiate the hydrolysis reaction whereby the heat from the exothermic hydrolysis reaction melts the first component 51.

The activation component 60, the second activation component 60', or both can comprise a rupture disk designed to rupture at a pressure; a device that creates a hole in the barrier 62 when activated, for example, by an uphole (e.g., above ground) or downhole trigger or timer; a dissolving plug; a mandrel with a port that opens at a design pressure; a pressure sensor; a trigger valve; a wireless receiver; a wired trigger; or a combination thereof.

The water-based fluid 57 reacts with the metal(s) of the second component 52 (e.g., magnesium), and the exothermic heat of reaction (Equation (1)) melts the (e.g., phase-expanding) fusible alloy of first component 51, to provide melted first component or "melted material" 53, which flows to create seal 59 upon solidification.

As noted in FIG. 5A, which is a schematic of a downhole tool 50, according to embodiments of this disclosure, and as noted hereinabove, a flow barrier 58 (e.g., comprising fins) can be used to minimize the fluid convection around the heater. The flow barrier 58 can help to retain the heat of the hydrolysis reaction near the forming seal 59. The flow barrier 58 can comprise fins, wipers, whiskers, cups, or any other disruption to the axial movement (e.g., of melted first component 51 and/or wellbore fluid). Heat transfer fins or other flow barrier 58 can thus help conduct heat from the dissolution or hydrolysis reaction of the metal(s) of second component 52 of Equation (1) into the (e.g., phase-expanding) fusible alloy of the first component 51. The fins or other flow barrier 58 can also ensure that the first component comprising the fusible alloy does not fall when the first component 51 melts.

Figure 6A:
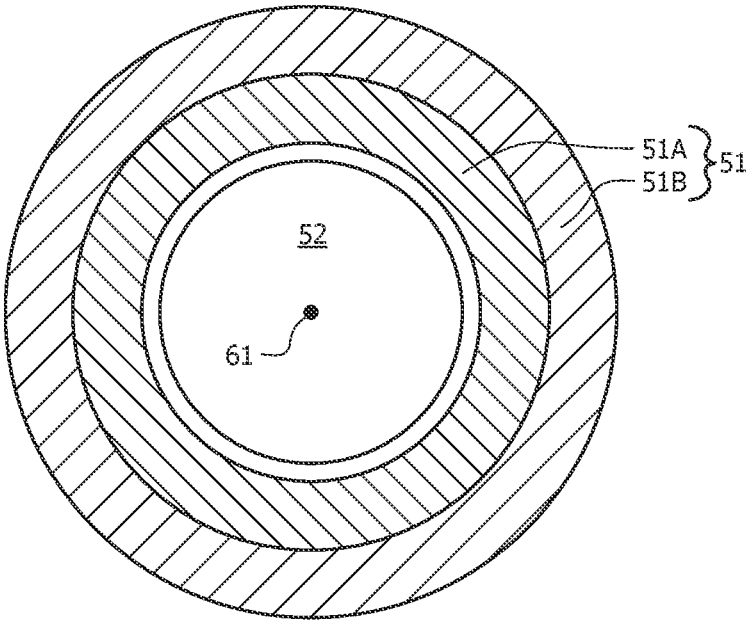
FIG. 6A is a schematic cross section of a tool, according to embodiments of this disclosure.
Figure 6B:
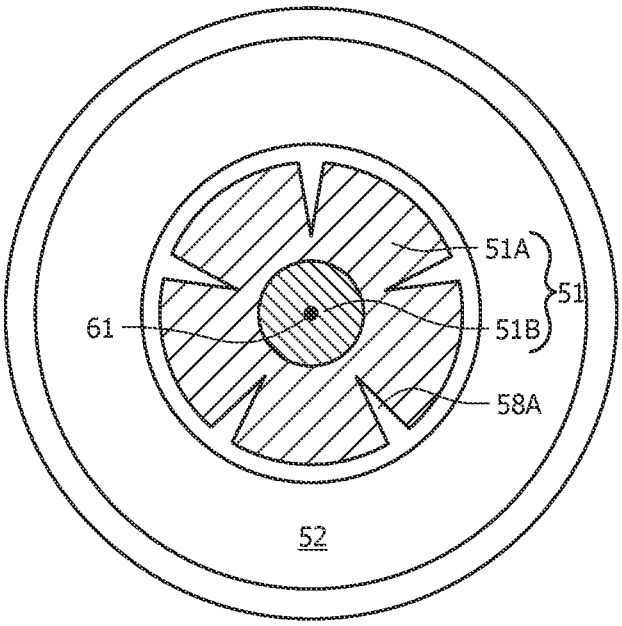
FIG. 6B is a schematic cross section of a tool, according to other embodiments of this disclosure.

The first component 51 comprising the (e.g., phase-expanding) fusible alloy can be placed on the inside diameter or surface 63 or the outside diameter or surface 64 of the tool 50, as shown in FIG. 6B and FIG. 6A, respectively.

Figure 5A:
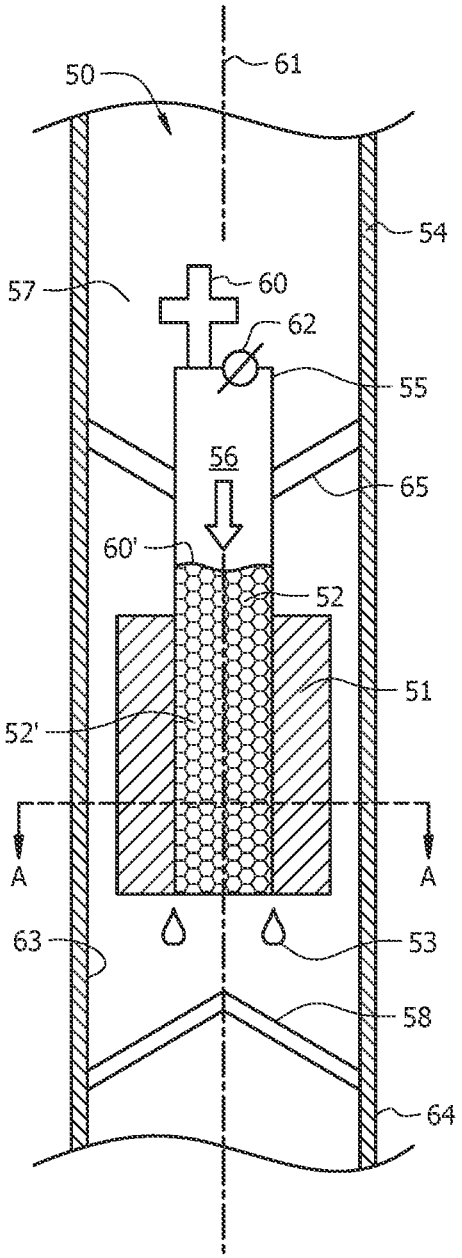
FIG. 5A is a schematic of a downhole tool, according to embodiments of this disclosure.

As depicted in FIG. 5A and FIG. 6A (described hereinbelow), in embodiments, the second component 52 comprising the metal can be positioned proximal a central axis 61 of the pressure vessel 55 (e.g., distal an inside surface 63 of the pressure vessel 55) relative to the first component 51. In other embodiments, such as depicted in FIG. 6B, described hereinbelow, the second component 52 comprising the metal is positioned distal the central axis 61 of the pressure vessel 55 (e.g., nearer the inside surface 63 of the pressure vessel 55) relative to the first component 51. With reference to FIG. 5A, creating seal 50 in a tubular 54 at 10 can comprise, at 11, positioning pressure vessel 55 in a wellbore (e.g., in tubular 54). First component 51 comprising the fusible alloy is then melted using heat produced by the exothermic, hydrolysis reaction of second component 52 comprising the metal, to provide melted fusible alloy 53 at 12. The melting at 12 can be activated by causing or allowing water-based fluid 57 (e.g., water in the wellbore), and optionally acid or base 56 contained in pressure vessel 55, to contact the metal (e.g., metal second component 52 in pellet or beaded form 52' contained within pressure vessel 55). At 14, the melted fusible alloy 53 is allowed to solidify (e.g., in the tubular 54 in FIG. 5A), wherein the fusible alloy expands upon solidifying and forms the seal 59 (within tubular 54 in FIG. 5A). The melted fusible alloy of first component 51 can be positioned, as indicated at 13 of FIG. 1, at a desired location (e.g., within tubular 54 in the embodiment of FIG. 5A), for example via the use/positioning of flow barrier 58 and/or via the use of magnets 70, as described further hereinbelow with reference to FIG. 7. Flow barrier 58 can include fins, wipers, or another barrier for example, as depicted in FIG. 5, at the top of the tool 50. Fins, wipers, or barrier 65 can extend, for example, from tool 50 to a casing wall. Flow barrier 58 can be utilized to hold the melted slurry/liquid in place while it solidifies. As a liquid, the melted material (e.g., melted fusible alloy 53) can have a viscosity similar to that of water and a density similar to that of steel, thus allowing them to escape unless a good support/barrier is present. In embodiments, the melted material can be positioned over a barrier that is already present, such as cement in an annulus. Utilizing a barrier(s) 58 can ensure that the melted fusible material 53 is not lost to a crack in the cement or between the cement and the tubing that could capture a lot of the fusible material.

Although depicted in FIG. 5A as inside a tubular 54 in a wellbore, the system and method of this disclosure can be utilized to for seal 59 in a variety of applications, including oil and gas and non-oil and gas applications. For example, the system and method of this disclosure can be utilized to form a seal 59 on the outside of a tubular 54 (e.g., in an annulus between a wellbore wall and an outside surface 64 of the tubular 54), as depicted in FIG. 7, and described hereinbelow.

With reference now to FIG. 6A, which is a schematic cross section of a tool 50 (such as along section A-A of FIG. 5A), according to embodiments of this disclosure, and FIG. 6B, which is a schematic cross section of a tool 50, according to other embodiments of this disclosure, in embodiments, first component 51 includes a first material 51A and a second material 51B, wherein the first material 51A or the second material 51B, or both, comprises a fusible alloy, wherein the first material 51A has a first material melting temperature T1 and the second material 51B has a second material melting temperature T2, and wherein the first material 51A melting temperature T1 is greater than the second material 51B melting temperature T2. In some such applications, multiple layers of phase-expanding fusible alloy can be utilized to form the seal 59, and first material 51A and 51B can both comprise a fusible alloy. One or both of the fusible alloy of the first material of first component 51A and the fusible alloy of second material 51B of first component 51 can comprise phase-expanding fusible alloys. In the embodiment of FIG. 6A, the inner material (first material 51A) of first component 51 can have a melting temperature T1 that is higher than the melting temperature, T2, of the outer material (second material 51B) of first component 51. As depicted in FIG. 6A, the second component 52 comprising the metal can be positioned proximal the central axis 61 of the pressure vessel 55 (e.g., farther from inside surface 63 of the pressure vessel 55) relative to first component 51. In such applications, first material 51A of first component 51 can be adjacent (e.g., surrounds) second component 52, and second material 51B of first component 51 can be adjacent (e.g., can surround) the first material 51A of first component 51. In such applications, heat generation along the central axis 61 produced by the hydrolysis reaction of second component 52 with water-based fluid 57 melts the first material 51A and the second material 51B.

This arrangement can allow the outer material (second material 51B), with lower melting temperature T2, to melt first and fall to be retained upon flow barrier 58. When the inner material (first material 51A) melts, it can fall and land atop the melted outer material (melted second material 51B), and the residual heat of the melted inner material (first material 51A) can help to re-melt and then solidify the originally deposited outer material (second material 51B).

With reference to FIG. 6B, in embodiments, the second component 52 can be positioned distal the central axis 61 of the pressure vessel 55 (e.g., nearer inside surface 63 of the pressure vessel 55) relative to the first component 51. In some such embodiments, second material 51B of first component 51 can be positioned proximal central axis 61 of the pressure vessel 55 (e.g., farther from inside surface 63 of pressure vessel 55) relative to the first material 51A, and first material 51A of first component 51 can be adjacent the second component 52 (e.g., can surround the first material 51A) and between second component 52 and second material 51B of first component 51. As noted above with regard to the embodiment of FIG. 6A, the arrangement of FIG. 6B can allow the inner material (second material 51B), with the lower melting temperature T2, to melt first and fall to be retained upon flow barrier 58. When outer material (first material 51A) melts, the melted outer material (first materiel 51A) can fall and land atop the melted inner material (melted second material 51B), and the residual heat of the melted outer material (melted first material 51A) can help to re-melt and then solidify the originally deposited inner material (second material 51B). As depicted in FIG. 6B, flow barrier 58 can provide heat transfer surfaces 58A, such as heat transfer vanes, fins, or other structures, to enhance heat transfer from the heat generation of the hydrolysis reaction (e.g., in the center (i.e., proximal central axis 61) for the embodiment of FIG. 6A and the outside (distal central axis 61 relative to first component 51) for the embodiment of FIG. 6B) to the first component 51 (e.g., to first material 51A and second material 51B of first component 51). Although not depicted in FIG. 6A, heat transfer surfaces 58A can optionally be used in any embodiment described herein.

Figure 2:
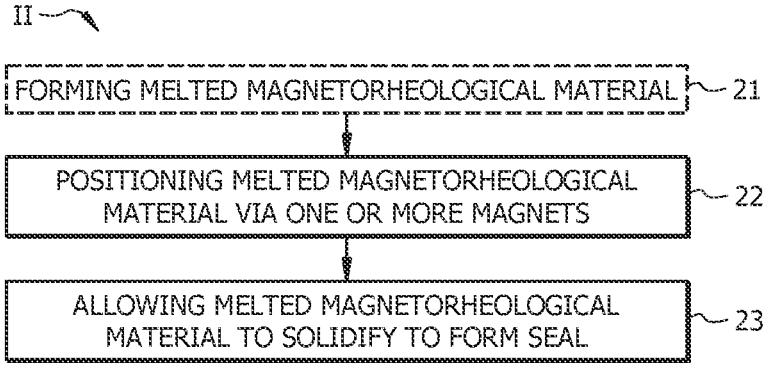
FIG. 2 is a schematic flow diagram of a method, according to embodiments of this disclosure.

A method comprising positioning of the melted first component 53 via one or more magnets 70 will now be described with reference to FIG. 2, which is a schematic flow diagram of a Method II according to embodiments of this disclosure, and FIG. 7, which is a schematic of a downhole tool 50', according to embodiments of this disclosure. Method II comprises: at 22, positioning a melted magnetorheological fusible alloy 51 (e.g., a melted "magnetorheological material" 51) at a selected location (e.g., within a tubular 54) via one or more magnets 70 (FIG. 7 described hereinbelow); and, at 23, allowing the melted magnetorheological material to solidify to form a seal 59. Method II can further comprise, at 21, forming the melted magnetorheological material by applying heat to a solid magnetorheological material. Applying heat can comprise producing heat via exothermic reaction, such as via an exothermic, metal hydrolysis reaction, as described hereinabove with reference to Equation (1). In Method II, one or more magnets 70 can be utilized to help hold the melted fusible alloy 53 in place during solidification. Iron powder or another magnetic component can be combined with the phase-expanding fusible alloy to provide first component 51 that is magnetic. As shown in FIG. 7, when the magnetorheological material (e.g., iron-infused molten alloy) comes into contact with the magnetic field 71 produced by the one or more (e.g., permanent) magnets 70, the melted fusible alloy 53 (e.g., the melted magnetorheological material), the magnetic field 71 serves to hold the melted fusible alloy 53 in place while it solidifies. Accordingly, the magnetic field 71 can act as a support for the melted phase-expanding fusible alloy of first component 51, which first component 51 here comprises a magnetorheological material, in a similar manner as flow barrier 58 of FIG. 5A. The one or more magnets 70 can be utilized alone, or in combination with flow barrier(s) 58.

As an example, bismuth can exhibit diamagnetic behavior, meaning that it is repelled by a magnetic field when it is a solid. Under certain high-pressure and high-temperature conditions, liquid bismuth can exhibit ferromagnetic behavior, meaning that it is attracted to a magnetic field. In particular, nickel-bismuth alloys exhibit a wild array of magnetic properties depending on the atomic ratio and the form of the nickel-bismuth alloy.

Figure 8:
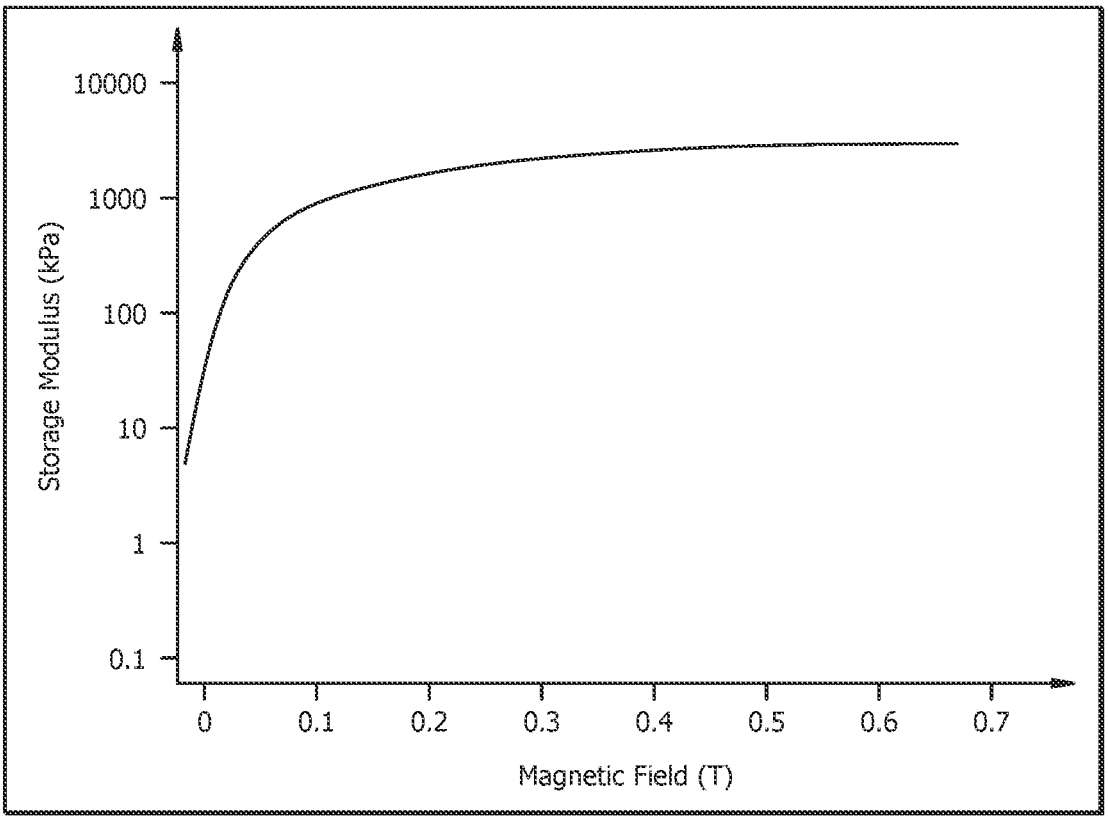
FIG. 8 is a plot of storage modulus as a function of magnetic field, according to embodiments of this disclosure.

The magnetic properties of the fusible alloy of first component 51 can be enhanced and made more predictable by dispersing micron-sized iron or nickel metal powder in the fusible alloy. When melted, the dispersed magnetic-responsive powder can be directed by the applied magnetic field 71. Accordingly, the melted first component 53 can be a liquid metal with the behaviors of a magnetorheological fluid or a ferrofluid. For example, as depicted in FIG. 8, which is a plot of storage modulus as a function of magnetic field, applying magnetic field 71 to a liquid fusible alloy that comprises 30% iron powder can increase the storage modulus from less than 10 kPa (no field) to over 1000 kPa (magnetic field of 0.4 tesla (T)). Accordingly, a fusible alloy comprising iron powder can behave as a magnetorheological fluid. This storage modulus of such a magnetorheological fusible alloy can be utilized to support or help to support the molten fusible alloy 53 while it solidifies.

The magnetorheological material can comprise any magnetorheological fusible alloy (e.g., a phase-expanding fusible alloy having magnetic properties), such as bismuth (Bi) or an alloy thereof (e.g., a nickel-bismuth alloy). As noted hereinabove, the magnetorheological material can comprise iron powder (e.g., 30, 35, 40 weight percent iron), or another magnetic component. The melted magnetorheological material can expand upon solidifying, as described hereinabove.

Figure 3:
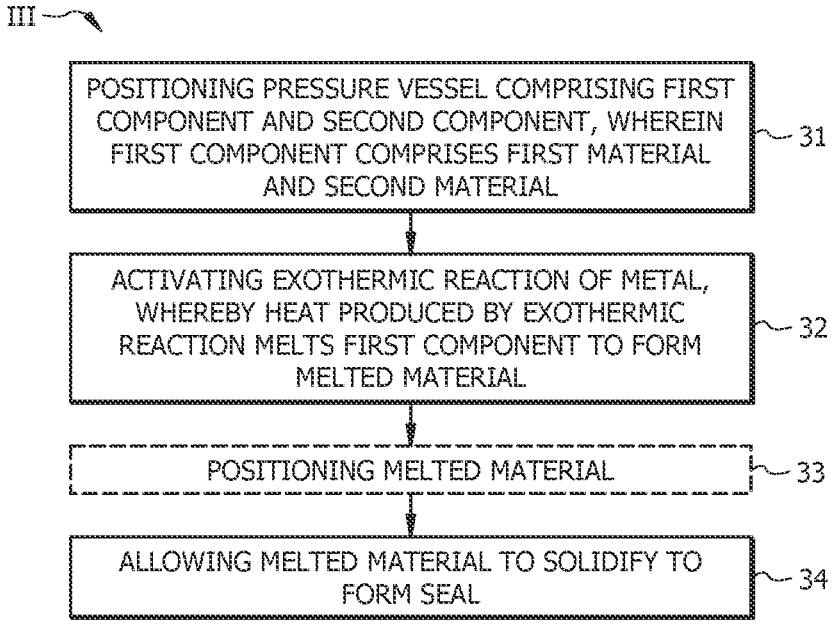
FIG. 3 is a schematic flow diagram of a method, according to embodiments of this disclosure.

With reference now to FIG. 3, which is a schematic flow diagram of a Method III, according to embodiments of this disclosure, in embodiments, a method of this disclosure comprises, at 31, positioning (e.g., within a tubular) a pressure vessel 55 comprising first component 51 comprising a fusible alloy and second component 52 comprising a metal, wherein the first component 51 comprises a first material 51A having a first material melting temperature T1 and a second material 51B having a second material melting temperature T2 (as described hereinabove with regard to FIGS. 6A/6B), activating, at 32, exothermic reaction of the metal, whereby heat produced by the exothermic reaction melts the first component 51 to form a melted material 53; and, at 34, allowing the melted material 53 to solidify to form a seal 59 (e.g., in the tubular 54). The first material 51A can comprise a fusible alloy, the second material 51B can comprise another fusible alloy, or the first material 51A can comprise a first fusible alloy and the second material 51B can comprise another fusible alloy. The first material 51A melting temperature T1 is greater than the second material 51B melting temperature T2. In embodiments, the melted material 53 comprises a phase-expanding fusible alloy, as described hereinabove, that expands upon solidifying.

As described with reference to FIG. 6A and FIG. 6B, the metal can be positioned proximal a central axis 61 of the pressure vessel 55 (e.g., farther from an inside surface 63 of the pressure vessel 55) relative to the first component 51, the first material 51A can be adjacent (e.g., surround) the second component 52, and the second material 51B can be adjacent (e.g., surround) the first material 51A; or the second component 52 can be positioned distal the central axis 61 of the pressure vessel 55 (e.g., nearer an inside surface 63 of the pressure vessel 55) relative to the first component 51, the second material 51B can be positioned proximal central axis 61 of the pressure vessel 55 (e.g., farther from inside surface 63 of the pressure vessel 55) relative to the first component 51A, and the first material 51A can be adjacent the second component 52 (e.g., can surround the second component 52) and between the second component 52 and the second material 51B.

As described hereinabove with reference to FIG. 1 and FIG. 2, Method III can further include positioning, at 33, the melted material 53 as described herein, for example via flow barrier 58 and/or one or more magnets 70.

Figure 4:
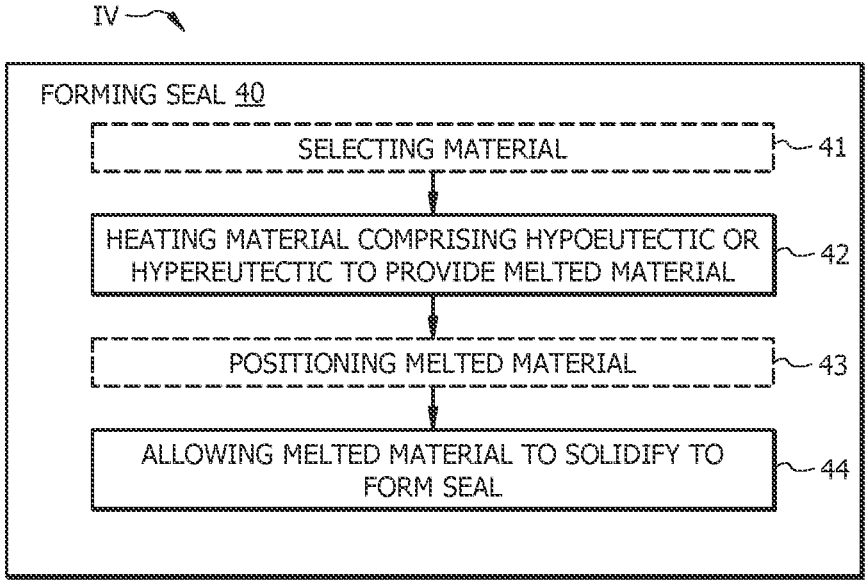
FIG. 4 is a schematic flow diagram of a method, according to embodiments of this disclosure.
Figure 5B:
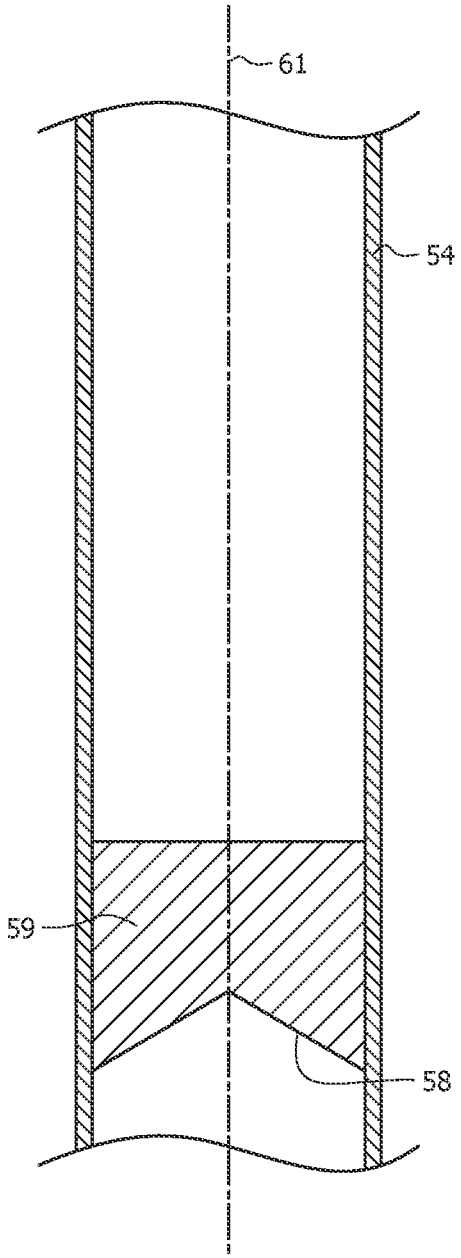
FIG. 5B is a schematic of a seal, according to embodiments of this disclosure.

FIG. 4 depicts a flow diagram of a Method IV according to embodiments of this disclosure. Method IV comprises forming a seal 40 (e.g., in a tubular 54) by: heating a material comprising a hypo-eutectic or a hyper-eutectic at 42 to provide a melted material; and allowing the melted material to solidify, at 44, to form the seal 59. Method IV is similar to Method I described hereinabove, wherein the first component 51 comprises the material comprising the hypo-eutectic or the hyper-eutectic. In embodiments, the material comprises a hypo-eutectic comprising a major component and a minor component, wherein the minor component is present in an amount less than an amount of the minor component in a eutectic mixture of the major component and the minor component. In embodiments, the material comprises a hyper-eutectic comprising a major component and a minor component, wherein the minor component is present in an amount greater than an amount of the minor component in a eutectic mixture of the major component and the minor component. In embodiments of Method IV, heating at 42 further comprises reacting a metal via an exothermic reaction and transferring heat produced by the exothermic reaction to the material. In applications of Method IV, another method of heating can be utilized. The exothermic reaction utilized to heat the material can comprise a hydrolysis of the metal, as described hereinabove with reference to Equation (1). In embodiments, the metal comprises magnesium (Mg).

Method IV can further comprise, at 43 positioning the melted material at a desired location (e.g., within the tubular 54). The positioning of the melted material 53 at the location at 43 can be effected as described hereinabove. For example, positioning at 43 can comprise (i) utilizing a flow barrier 58 (e.g., in tubular 54) to direct the melted material 53 to and/or maintain the melted material 53 at the location, and/or (ii) the material can comprise a magnetorheological material, as described herein, and positioning the melted material at 43 can comprise employing a magnet 70 (e.g., within the tubular 50, or at another desired location) to direct the melted material 53 to and/or maintain the melted material 53 at the desired location. Accordingly, as described hereinabove with regard to FIG. 2 and FIG. 7, in embodiments, Method IV can further comprise incorporating a magnetic component in the material to make it a magnetorheological material. As detailed hereinabove, the magnetic component can comprise iron, or another magnetic component. As described hereinabove with reference to FIG. 6A and FIG. 6B, the material can include a first material 51A having a first material melting temperature T1 and a second material 51B having a second material melting temperature T2, wherein the first material melting temperature T1 is greater than the second material melting temperature T2.

Method IV can further comprise, as depicted at 41 of FIG. 4, selecting the material such that the exothermic reaction of the metal provides sufficient heat to increase a temperature of the material to a temperature greater than a melting point thereof. That is, the material can be selected to have a desired melting temperature. The material can comprise a phase-expanding alloy (e.g., a phase-expanding hypo-eutectic or a phase-expending hyper-eutectic), such that the melted material 53 expands upon solidifying.

Also provided herein is wellbore tool 50 comprising: pressure vessel 55 containing (e.g., pellets of) at least one material 51 and a metal, and comprising an activation component 60/60' configured to, when activated, cause failure of a barrier 62 such that water contacts the metal to initiate an exothermic reaction and heat from the exothermic reaction melts the at least one material to provide a melted material. In some specific embodiments, the metal in the wellbore tool 50 comprises magnesium (and the heating is provided at least on part via hydrolysis of the magnesium). The activation component 60/60' can include an activation component described hereinabove, or another activation component 60/60'. For example, in embodiments, activation component 60/60' comprises a rupture disk designed to rupture at a design pressure. The design pressure is a pressure within a wellbore at a location at which the seal 59 is to be provided by solidification of the melted material 53.

In embodiments, a seal 59 of this disclosure can be formed without using a eutectic composition (e.g., by utilizing a hypo-eutectic or a hyper-eutectic as described herein), with any heating, such as thermite reaction or via hydrolysis reaction of Equation (1). In embodiments, a seal 59 of this disclosure can be formed without using thermite, for example, by melting a first component comprising a fusible alloy (e.g., a phase-expanding or non-phase-expanding fusible alloy that is or is not magnetorheological and comprises a eutectic, a hypo-eutectic, and/or a hyper-eutectic) via hydrolysis reaction of at least one metal X via a hydrolysis reaction of Equation (1).

The heat released from a metal hydroxide reaction of Equation (1) is released more slowly and at a greater energy density than a thermite reaction. Thermite has a rapid burn time and space-consuming additives are often needed to slow the reaction. The equilibrium reaction temperature of the iron thermite reaction is generally around the temperature of molten iron, 1800° C. to 2500° C. That temperature is hot enough to potentially damage apparatus, such as downhole tools, that will contact the seal 59 during creation thereof. The energy density of the thermite reaction generally ranges from a theoretical high of 18 kJ/cm3 to a more practical 3 kJ/cm3. The energy density of the metal hydroxide reactions of Equation (1) can vary, for example, from 27 kJ/cm3 for a magnesium hydroxide reaction to 41 kJ/cm3 for an aluminum hydroxide reaction. Thus, the metal dissolution reactions of Equation (1) can release from two to over ten times more energy than an iron thermite reaction.

Additionally, thermite reactions can be difficult to initiate. Initiation of the thermite reaction typically requires providing very high temperatures to the components. The common Al—$Fe_2O_3$ thermite, for example, requires an initiation temperature of at least 1700° C. By contrast, metal dissolution reactions of Equation (1) are simply initiated by introducing water or acidized water (e.g. water-based fluid 57) around the metal of second component 52.

Another limitation of heating via thermite, is that thermite is a regulated material. In the United States, thermite is classified as a flammable solid, which limits transportation and storage of thermite. In other countries, thermite is treated as a dual-use military material and some countries have more extensive permitting requirements. By contrast, metals for use in a metal dissolution reaction of Equation (1) are not regulated. Thus, although thermite can be utilized in some embodiments of this disclosure (e.g., to melt the hypo-eutectic or hyper-eutectic material of the Method IV of FIG. 4 or to melt the magnetorheological fusible alloy of the Method II of FIG. 2, in embodiments of the method disclosed herein (e.g., Method I of the embodiment of FIG. 1, Method II of the embodiment of FIG. 2, Method III of the embodiment of FIG. 3, or Method IV of the embodiment of FIG. 4), heat for melting is providing by hydrolysis reaction(s) of one or more metals X, as per Equation (1).

Herein disclosed are systems and methods for creating a high-strength metal-to-metal seal 59, such as for plugging or zonal isolation in a wellbore. The seal 59 can comprise a fusible alloy that expands as it solidifies to create a tight seal, such as for plug-and-abandon or as a casing packer (open hole isolation). In embodiments, the system and method of this disclosure provide for the creation of an "instant" seal 59, for example, that appears at the push of a button or flipping of a switch.

In embodiments, a fusible alloy with a low melting temperature is utilized to create the seal 59. There are some fusible alloys that expand when solidifying. In embodiments, such a phase-expanding fusible alloy is utilized to create the seal 59. The phase-expanding behavior upon solidification can place the alloy under compression, which can help to form the seal 59 and provide an anchoring load.

The fusible alloy of a first component 51 can be melted at or near the desired seal 59 location (e.g., downhole) by creating heat from the mixing of water-based fluid 57 (e.g., comprising acid to accelerate the hydrolysis reaction as described herein) with the metal (e.g., magnesium) of a second component 52. The hydrolysis can provide one of the most energy dense forms of heat via common and safe materials. In embodiments, seal 59 can be created by melting the first component with the heat from metal hydrolysis or from metal dissolution (e.g., magnesium reaction).

In embodiments, one or more magnets 70 and/or flow barriers 58 can be utilized to guide the placement of a fusible alloy (e.g., a magnetorheological fusible alloy).

In embodiments, a multi-melt fusible alloy (e.g., a hypo-eutectic or a hypo-eutectic) can be utilized to form seal 59 (e.g., as a part of a pump-down plug). The fusible alloy of the first component 51 can thus comprise a hypo-eutectic or hyper-eutectic fusible alloy, in embodiments.

Plug-and-abandon is a multi-billion dollar opportunity. The herein disclosed system and method can be utilized to create a plug-and-abandon seal 59. It can be used alone are in conjunction with conventional techniques.

Other advantages will be apparent to those of skill in the art and with the help of this disclosure.

ADDITIONAL DISCLOSURE

The following are non-limiting, specific embodiments in accordance with the present disclosure:

In a first embodiment, a method comprises: creating a seal in a tubular by melting a first component comprising a fusible alloy, using heat produced by an exothermic, hydrolysis reaction of a second component comprising a metal, to provide a melted fusible alloy, and allowing the melted fusible alloy to solidify in the tubular, wherein the fusible alloy expands upon solidifying and forms the seal.

A second embodiment can include the method of the first embodiment, wherein the fusible alloy expands at least 0.005%, 0.05, 0.1, 0.2, 0.3, 0.4, 0.5, 0.6, 0.7, 0.8, 0.9, 1, 2, 3, 4, or 5 volume percent (vol %), or in a range of from about 0.05 to 5, 0.1 to 5, or 0.1 to 1 vol % upon solidifying.

A third embodiment can include the method of the first or second embodiment, wherein the fusible alloy has a solidus temperature less than or equal to 550, 540, 530, or 520° F.

A fourth embodiment can include the method of any one of the first to third embodiments, wherein the fusible alloy comprises a metal, a metalloid, an alloy thereof, or a combination thereof.

A fifth embodiment can include the method of the fourth embodiment, wherein the fusible alloy comprises bismuth (Bi), gallium (Ga), antimony (Sb), germanium (Ge), an alloy thereof, or a combination thereof.

A sixth embodiment can include the method of the fourth or fifth embodiment, wherein the fusible alloy comprises greater than 40 weight percent (wt %) Bi.

A seventh embodiment can include the method of the sixth embodiment, wherein the fusible alloy comprises a Bi alloy, further comprising lead (Pb), tin (Sn), cadmium (Cd), indium (In), antimony (Sb), or a combination thereof.

An eighth embodiment can include the method of any one of the first to seventh embodiments, wherein the fusible alloy is a hypo-eutectic alloy or a hyper-eutectic alloy.

A ninth embodiment can include the method of nay one of the fourth to eighth embodiments, wherein the first component comprises greater than about 40 weight percent (wt %) gallium (Ga).

A tenth embodiment can include the method of any one of the first to ninth embodiments, wherein the hydrolysis reaction occurs between the metal and a water-based liquid.

An eleventh embodiment can include the method of any one of the first to tenth embodiments, wherein the second component comprises barium (Ba), calcium (Ca), lithium (Li), aluminum (Al), magnesium (Mg), or a combination thereof.

A twelfth embodiment can include the method of any one of the first to eleventh embodiments, wherein the second component comprises, consists essentially of, or consists of magnesium (Mg)

A thirteenth embodiment can include the method of any one of the first to twelfth embodiments, wherein the second component comprises an alkaline earth metal, a transition metal, a post-transition metal, or a combination thereof.

A fourteenth embodiment can include the method of the thirteenth embodiment, wherein the second component comprises magnesium (Mg), calcium (Ca), aluminum (Al), zinc (Zn), or a combination thereof.

A fifteenth embodiment can include the method of the thirteenth or fourteenth embodiment, wherein the second component comprises magnesium (Mg) or a Mg alloy comprising Mg and one or more additional metals.

A sixteenth embodiment can include the method of the fifteenth embodiment, wherein the one or more additional metals comprise aluminum (Al), zinc (Zn), manganese (Mn), zirconium (Zr), yttrium (Y), neodymium (Nd), gadolinium (Gd), silver (Ag), calcium (Ca), tin (Sn), rhenium (Re), or a combination thereof.

A seventeenth embodiment can include the method of any one of the thirteenth to sixteenth embodiments, wherein the second component (e.g., Mg alloy) further comprises a dopant.

An eighteenth embodiment can include the method of the seventeenth embodiment, wherein the dopant comprises nickel (Ni), iron (Fe), copper (Cu), cobalt (Co), iridium (Ir), gold (Au), palladium (Pd), gallium (Ga), magnesium (Mg), or a combination thereof.

A nineteenth embodiment can include the method of any one of the first to eighteenth embodiments, wherein the hydrolysis reaction comprises reaction of magnesium (Mg) with water.

A twentieth embodiment can include the method of the nineteenth embodiment, wherein the hydrolysis reaction is in the presence of an organic acid or an inorganic acid.

A twenty first embodiment can include the method of the twentieth embodiment, wherein the acid comprises hydrochloric acid, citric acid, acetic acid, formic acid, hydrofluoric acid, carbonic acid, or a combination thereof.

A twenty second embodiment can include the method of any one of the first to twenty first embodiments, wherein the seal is for plug and abandon of a well, a casing packer (e.g., for open hole isolation), a bridge plug, a frac plug, or a temporary barrier.

A twenty third embodiment can include the method of any one of the first to twenty second embodiments, further comprising positioning the seal at a desired location within the tubular.

A twenty fourth embodiment can include the method of the twenty third embodiment, wherein positioning further comprises restricting or preventing axial fluid flow within the tubular at the desired location.

A twenty fifth embodiment can include the method of the twenty fourth embodiment, wherein positioning comprises restricting axial fluid flow via placement of a flow barrier within the tubular.

A twenty sixth embodiment can include the method of the twenty fifth embodiment, wherein the flow barrier comprises one or a plurality of fins, wipers, whiskers, cups, or another flow barrier that restricts axial flow of fluid within the tubular.

A twenty seventh embodiment can include the method of any one of the twenty third to twenty sixth embodiments, wherein the melted fusible alloy is a magnetorheological material (e.g., a fusible alloy), and wherein positioning further comprises utilizing magnets to guide placement of the melted fusible alloy.

A twenty eighth embodiment can include the method of any one of the first to twenty seventh embodiments, comprising at least two fusible alloys.

A twenty ninth embodiment can include the method of any one of the first to twenty eighth embodiments, wherein creating the seal further comprises positioning a pressure vessel comprising (e.g., pellets of) the first component within the tubular, wherein the pressure vessel contains the first component, wherein the first component is adjacent the metal, and wherein the pressure vessel comprises an activation component configured to, when activated, cause failure of a barrier such that water contacts the metal to initiate the hydrolysis reaction whereby the heat from the reaction melts the first component.

A thirtieth embodiment can include the method of the twenty ninth embodiment, wherein the activation component comprises a rupture disk designed to rupture at a pressure, a device that creates a hole in the barrier when activated by an uphole (e.g., above ground) or downhole trigger or timer, a dissolving plug, a mandrel with a port that opens at a design pressure, a pressure sensor, a trigger valve, a wireless receiver, a wired trigger, or a combination thereof.

A thirty first embodiment can include the method of the twenty ninth or thirtieth embodiments, wherein the metal is positioned proximal a central axis of the pressure vessel relative to the first component, or wherein the metal is positioned distal the central axis of the pressure vessel of the pressure vessel relative to the first component.

A thirty second embodiment can include the method of any one of the twenty ninth to thirty first embodiments, wherein the first component includes a first material and a second material, wherein the first material or the second material comprises the fusible alloy, wherein the first material has a first material melting temperature and the second material has a second material melting temperature, and wherein the first material melting temperature is greater than the second material melting temperature.

A thirty third embodiment can include the method of the thirty second embodiment, wherein the metal is positioned proximal a central axis of the pressure vessel relative to the first component, wherein the first material is adjacent (e.g., surrounds) the metal, and wherein the second material is adjacent (e.g., surrounds) the first material.

A thirty fourth embodiment can include the method of the thirty second embodiment, wherein the metal is positioned distal the central axis of the pressure vessel relative to the first component, and wherein the second material is positioned proximal a central axis of the pressure vessel of the pressure vessel relative to the metal, and wherein the first material is adjacent the metal (e.g., surrounds the metal) and between the metal and the second material.

A thirty fifth embodiment can include the method of any one of the first to thirty fourth embodiments, wherein the first component further comprises an inert material with a heat capacity of greater than about 2 $MJ/(Km^3)$, a non-phase-expending fusible ally, and/or heat transfer fins distributed throughout to transfer heat from the hydrolysis reaction to the first component.

A thirty sixth embodiment can include the method of the thirty fifth embodiment, wherein the inert material comprises particles (e.g., iron, bronze, nickel granules or powder), a non-phase expanding fusible alloy, or a combination thereof.

A thirty seventh embodiment can include the method of the thirty sixth embodiment, wherein the inert material comprises iron particles that are acicular (i.e., needle shaped), cylindrical, elliptical, or a combination thereof.

A thirty eighth embodiment can include the method of any one of the first to thirty seventh embodiments, wherein the hydrolysis reaction comprises a reaction according to the formula: $X_{(s)}+2H_2O_{(l)} \rightarrow X(OH)_{2\ (g\ or\ s)}+H_{2\ (g)}$, wherein X comprises the metal.

A thirty ninth embodiment can include the method of any one of twenty ninth to thirty eighth embodiments, wherein the pressure vessel is or is contained within a downhole tool.

A fortieth embodiment can include the method of the thirty ninth embodiment, wherein the downhole tool comprises a wireline or slickline tool.

In a forty first embodiment, a method comprises: positioning a melted magnetorheological material (e.g., a magnetorheological fusible alloy) at a selected location within a tubular via one or more magnets; and allowing the melted magnetorheological material to solidify to form a seal.

A forty second embodiment can include the method of the forty first embodiment, further comprising forming the melted magnetorheological material by applying heat to a magnetorheological material.

A forty third embodiment can include the method of the forty second embodiment, wherein applying heat further comprises producing heat via exothermic reaction.

A forty fourth embodiment can include the method of the forty third embodiment, wherein the exothermic reaction is a metal hydrolysis reaction.

A forty fifth embodiment can include the method of any one of the forty first to forty fourth embodiments, wherein the magnetorheological material comprises bismuth (Bi) or an alloy thereof (e.g., a nickel-bismuth alloy).

A forty sixth embodiment can include the method of any one of the forty first to forty fifth embodiments, wherein the magnetorheological material comprises iron powder (e.g., 30 weight percent iron).

A forty seventh embodiment can include the method of any one of the forty first to forty sixth embodiments, wherein the melted magnetorheological material expands upon solidifying.

In the forty eighth embodiment, a method comprises: positioning, within a tubular, a pressure vessel comprising a first component comprising a fusible alloy and a second component comprising a metal, wherein the first component comprises a first material having a first material melting temperature and a second material having a second material melting temperature, wherein the first material comprises a fusible alloy, wherein the second material comprises another fusible alloy, or wherein the first material comprises the first fusible alloy and the second material comprises the another fusible alloy, wherein the first material melting temperature is greater than the second material melting temperature; activating exothermic reaction of the metal, whereby heat produced by the exothermic reaction melts the first component to form a melted material; and allowing the melted material to solidify to form a seal in the tubular.

A forty ninth embodiment can include the method of the forty eighth embodiment, wherein the melted material expands upon solidifying.

A fiftieth embodiment can include the method of the forty ninth or fiftieth embodiment, wherein: the metal is positioned proximal a central axis of the pressure vessel relative to the first component, the first material is adjacent (e.g., surrounds) the metal, and the second material is adjacent (e.g., surrounds) the first material; or the metal is positioned distal the central axis of the pressure vessel of the pressure vessel relative to the first component, the second material is positioned proximal a central axis of the pressure vessel relative to the first component, and the first material is adjacent the metal (e.g., surrounds the metal) and between the metal and the second material.

In a fifty first embodiment, a method comprises: forming a seal in a tubular by: heating a material comprising a hypo-eutectic or a hyper-eutectic to provide a melted material; and allowing the melted material to solidify to form the seal.

A fifty second embodiment can include the method of the fifty first embodiment, wherein the material comprises a hypo-eutectic comprising a major component and a minor component, wherein the minor component is present in an amount less than an amount of the minor component in a eutectic mixture of the major component and the minor component.

A fifty third embodiment can include the method of the fifty first or fifty second embodiment, wherein the material comprises a hyper-eutectic comprising a major component and a minor component, wherein the minor component is present in an amount greater than an amount of the minor component in a eutectic mixture of the major component and the minor component.

A fifty fourth embodiment can include the method of any one of the fifty first to fifty third embodiments, wherein heating further comprises reacting a metal via an exothermic reaction and transferring heat produced by the exothermic reaction to the material.

A fifty fifth embodiment can include the method of the fifty fourth embodiment, wherein the exothermic reaction comprises hydrolysis of the metal via the equation: $X_{(s)}+2H_2O_{(l)} \rightarrow X(OH)_{2\ (g\ or\ s)}+H_{2\ (g)}$, wherein X comprises the metal.

A fifty sixth embodiment can include the method of any one of the fifty first to fifty fifth embodiments, wherein the metal comprises (consists of, or consists essentially of) magnesium (Mg).

A fifty seventh embodiment can include the method of any one of the fifty first to fifty sixth embodiments, further comprising positioning the melted material at a location within the tubular.

A fifty eighth embodiment can include the method of the fifty seventh embodiment, wherein positioning the melted material at the location within the tubular further comprises (i) utilizing a flow barrier in the tubular to direct the melted material to and/or maintain the melted material at the location, and/or (ii) wherein the at least one material comprises a magnetorheological material and positioning the melted material further comprises employing a magnet within the tubular to direct the melted material to and/or maintain the melted material at the location.

A fifty ninth embodiment can include the method of any one of the fifty first to fifty eighth embodiments, further comprising incorporating a magnetic component in the material to make it a magnetorheological material.

A sixtieth embodiment can include the method of the fifty ninth embodiment, wherein the magnetic component comprises iron.

A sixty first embodiment can include the method of any one of the fifty first to sixtieth embodiments, wherein the first component comprises (e.g., a multi-melt fusible alloy) a first material having a first material melting temperature and a second material having a second material melting temperature, wherein the first material melting temperature is greater than the second material melting temperature.

A sixty second embodiment can include the method of the sixty first embodiment further comprising selecting the material such that the exothermic reaction of the metal provides sufficient heat to increase a temperature of the material to a temperature greater than a melting point thereof.

A sixty third embodiment can include the method of any one of the fifty first to sixty second embodiments, wherein the melted material expands upon solidifying.

In a sixty fourth embodiment, a wellbore tool comprises: a pressure vessel containing (e.g., pellets of) at least one material and a metal, and comprising an activation component configured to, when activated, cause failure of a barrier such that water contacts the metal to initiate an exothermic reaction and heat from the exothermic reaction melts the at least one material to provide a melted material.

A sixty fifth embodiment can include the wellbore tool of the sixty fourth embodiment, wherein the metal comprises magnesium, and wherein the activation component comprises a rupture disk designed to rupture at a design pressure.

A sixty sixth embodiment can include the wellbore tool of the sixty fifth embodiment, wherein the design pressure is a pressure within a wellbore at a location at which a seal is to be provided by solidification of the melted material.

A sixty seventh embodiment can include the wellbore tool of any one of the sixty fourth to sixty sixth embodiments, wherein the melted material expands upon solidifying.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . 95 percent, 96 percent, 97 percent, 98 percent, 99 percent, or 100 percent. Moreover, any numerical range defined by two R numbers as defined in the above is also specifically disclosed. Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A method for creating a seal at a location in a tubular comprising:

positioning a flow barrier at the location in the tubular;

positioning a first component comprising a fusible alloy and a second component comprising a metal downhole in the tubular, wherein the first component is proximate the second component;

melting the first component comprising the fusible alloy, using heat produced by an exothermic, hydrolysis reaction of the second component comprising the metal, to provide a melted fusible alloy restricted from flowing by the flow barrier, and solidifying the melted fusible alloy at the location in the tubular, wherein the fusible alloy is a phase-expanding fusible alloy that expands upon solidifying and forms the seal.

2. The method of claim 1:

wherein the fusible alloy comprises bismuth (Bi), gallium (Ga), antimony (Sb), germanium (Ge), an alloy thereof, or a combination thereof; and/or wherein the second component comprises barium (Ba), calcium (Ca), lithium (Li), aluminum (Al), magnesium (Mg), or a combination thereof.

3. The method of claim 1:

wherein the fusible alloy comprises a Bi alloy, further comprising lead (Pb), tin (Sn), cadmium (Cd), indium (In), antimony (Sb), or a combination thereof; and/or wherein the fusible alloy is a hypo-eutectic alloy or a hyper-eutectic alloy.

4. The method of claim 1, wherein the hydrolysis reaction occurs between the metal and a water-based liquid.

5. The method of claim 1, wherein the hydrolysis reaction comprises reaction of magnesium (Mg) with water, and/or wherein the hydrolysis reaction is in the presence of an organic acid or an inorganic acid.

6. The method of claim 1, wherein the hydrolysis reaction comprises a reaction according to the formula:

$$X_{(s)}+2H_2O_{(l)}\rightarrow X(OH)_{2\ (g\ or\ s)}H_{2\ (g)},$$

wherein X comprises the metal.

7. The method of claim 1, wherein the hydrolysis reaction comprises reaction of magnesium (Mg) with water.

8. The method of claim 1, further comprising positioning a pressure vessel comprising the first component within the tubular, wherein the pressure vessel contains the first component, and wherein the pressure vessel comprises an activation component configured to, when activated, cause failure of a barrier such that water contacts the metal to initiate the hydrolysis reaction whereby the heat from the hydrolysis reaction melts the first component.

9. A method for creating a seal at a location in a tubular comprising:

melting a first component comprising a fusible alloy, using heat produced by an exothermic, hydrolysis reaction of a second component comprising a metal, to provide a melted fusible alloy, and solidifying the melted fusible alloy at the location in the tubular, wherein the fusible alloy expands upon solidifying and forms the seal; and positioning the seal at the location by: restricting or preventing axial fluid flow within the tubular at the desired location via placement of a flow barrier within the tubular; and/or wherein the melted fusible alloy is a magnetorheological material, and wherein positioning comprises utilizing magnets positioned proximate the location to guide placement of the melted fusible alloy.

10. The method of claim 9:

wherein the fusible alloy comprises a Bi alloy, further comprising lead (Pb), tin (Sn), cadmium (Cd), indium (In), antimony (Sb), or a combination thereof; and/or wherein the fusible alloy is a hypo-eutectic alloy or a hyper-eutectic alloy.

11. The method of claim 9, wherein the hydrolysis reaction occurs between the metal and a water-based liquid.

12. The method of claim 9, wherein the hydrolysis reaction comprises reaction of magnesium (Mg) with water, and/or wherein the hydrolysis reaction is in the presence of an organic acid or an inorganic acid.

13. The method of claim 9, wherein the hydrolysis reaction comprises a reaction according to the formula:

$$X_{(s)}+2H_2O_{(l)}\rightarrow X(OH)_{2\ (g\ or\ s)}H_{2\ (g)},$$

wherein X comprises the metal.

14. The method of claim 9:

wherein the fusible alloy comprises bismuth (Bi), gallium (Ga), antimony (Sb), germanium (Ge), an alloy thereof, or a combination thereof; and/or wherein the second component comprises barium (Ba), calcium (Ca), lithium (Li), aluminum (Al), magnesium (Mg), or a combination thereof.

15. A method for creating a seal at a location in a tubular comprising:

melting a first component comprising a fusible alloy, using heat produced by an exothermic, hydrolysis reaction of a second component comprising a metal, to provide a melted fusible alloy, and solidifying the melted fusible alloy at the location in the tubular, wherein the fusible alloy expands upon solidifying and forms the seal, wherein creating the seal further comprises positioning a pressure vessel comprising the first component within the tubular at or adjacent the location, wherein the pressure vessel contains the first component, wherein the first component is adjacent the metal, and wherein the pressure vessel comprises an activation component configured to, when activated, cause failure of a barrier such that water contacts the metal to initiate the hydrolysis reaction whereby the heat from the reaction melts the first component to provide the melted fusible alloy at the location.

16. The method of claim 15:

wherein the fusible alloy comprises a Bi alloy, further comprising lead (Pb), tin (Sn), cadmium (Cd), indium (In), antimony (Sb), or a combination thereof; and/or wherein the fusible alloy is a hypo-eutectic alloy or a hyper-eutectic alloy.

17. The method of claim 15, wherein the hydrolysis reaction occurs between the metal and a water-based liquid.

18. The method of claim 15, wherein the hydrolysis reaction comprises reaction of magnesium (Mg) with water, and/or wherein the hydrolysis reaction is in the presence of an organic acid or an inorganic acid.

19. The method of claim 15, wherein the hydrolysis reaction comprises a reaction according to the formula:

$$X_{(s)}+2H_2O_{(l)}\rightarrow X(OH)_{2\ (g\ or\ s)}H_{2\ (g)}$$

wherein X comprises the metal.

20. The method of claim 15:

wherein the fusible alloy comprises bismuth (Bi), gallium (Ga), antimony (Sb), germanium (Ge), an alloy thereof, or a combination thereof; and/or wherein the second component comprises barium (Ba), calcium (Ca), lithium (Li), aluminum (Al), magnesium (Mg), or a combination thereof.

* * * * *